US008737660B2

(12) United States Patent
Takahashi et al.

(10) Patent No.: US 8,737,660 B2
(45) Date of Patent: May 27, 2014

(54) ELECTRIC HORN

(75) Inventors: Hidefumi Takahashi, Isesaki (JP); Toshio Takahashi, Kiryu (JP); Yoshihiro Murakoshi, Toyokawa (JP)

(73) Assignee: Mitsuba Corporation (JP)

( * ) Notice: Subject to any disclaimer, the term of this patent is extended or adjusted under 35 U.S.C. 154(b) by 940 days.

(21) Appl. No.: 12/676,684

(22) PCT Filed: Sep. 4, 2008

(86) PCT No.: PCT/JP2008/002437
§ 371 (c)(1),
(2), (4) Date: Apr. 15, 2010

(87) PCT Pub. No.: WO2009/031308
PCT Pub. Date: Mar. 12, 2009

(65) Prior Publication Data

US 2010/0246875 A1 Sep. 30, 2010

(30) Foreign Application Priority Data

Sep. 7, 2007 (JP) ..... 2007-232254
Sep. 3, 2008 (JP) ..... 2008-225875

(51) Int. Cl.
*H04R 1/20* (2006.01)

(52) U.S. Cl.
USPC ..... 381/340; 381/396; 381/341

(58) Field of Classification Search
USPC ..... 381/340, 341, 396, 152; 340/391.1
See application file for complete search history.

(56) References Cited

U.S. PATENT DOCUMENTS

| | | | | |
|---|---|---|---|---|
| 3,906,490 | A * | 9/1975 | Shaw | 340/391.1 |
| 4,317,009 | A * | 2/1982 | Shintaku | 381/341 |
| 5,022,341 | A * | 6/1991 | Eveanowsky et al. | 116/142 FP |
| 6,389,148 | B1 | 5/2002 | Yoo et al. | |
| 6,816,065 | B2 * | 11/2004 | Viero | 340/384.1 |
| 2002/0094095 | A1 * | 7/2002 | Ellis et al. | 381/152 |
| 2007/0071271 | A1 * | 3/2007 | Ushikoshi et al. | 381/396 |

FOREIGN PATENT DOCUMENTS

| | | |
|---|---|---|
| JP | 2001-195073 | 7/2001 |
| JP | 2001-287588 | 10/2001 |
| JP | 2002-162971 | 6/2002 |
| JP | 2002-531037 | 9/2002 |
| JP | 2002-297144 | 10/2002 |
| JP | 2003-39019 | 2/2003 |
| JP | 2003-189386 | 7/2003 |

* cited by examiner

*Primary Examiner* — Duc Nguyen
*Assistant Examiner* — Phan Le
(74) *Attorney, Agent, or Firm* — Gerald E. Hespos; Michael J. Porco; Matthew T. Hespos

(57) ABSTRACT

An electric horn (1) has a coil bobbin (4) in a casing (2). A fixed iron core (3) is fixed in a hole (4*f*) in the coil bobbin (4) and is magnetized to define an exciting coil (C). A moving iron core (10) is at the center of a diaphragm (9) at the open end of the casing (2) and faces the fixed iron core (3). The moving iron core (10) is displaced relative to the fixed iron core (3) by a power supply of the exciting coil (C); thus beeping an alarm. The moving iron core (10) has an end face toward the fixed iron core (3) that strides over a reference position (N) within the amplitude (W) of the moving iron core (10). The end portion on the moving iron core (10) side of the wound portion (4*e*) of the exciting coil (C) is the reference position (N).

12 Claims, 3 Drawing Sheets

ELECTRIC HORN

BACKGROUND OF THE INVENTION

1. Field of the Invention

The present disclosure relates to an electric horn mounted in a vehicle such as a passenger car.

2. Description of the Related Art

There exists an electric horn that concentrically holds an exciting coil at a bottom of a closed-end tubular casing. The coil is formed by winding a wire around a coil bobbin with a tubular wire-wound portion. A fixed iron core is fixed into a tubular bore of the wire-wound portion of the coil bobbin. The fixed iron core is magnetized when the exciting coil is excited by a power supply. A diaphragm is fixed at an open end of the casing, and a movable iron core is provided at a shaft center of the diaphragm. The movable iron core and the fixed iron core are placed to face each other in an axial direction. A node contact breaker means is provided to the movable iron core in order to break a contact with a node member that is provided in a power supply circuit of the exciting coil. The movable iron core is suctioned from a position of a resting state (resting position) in which power is not supplied to the exciting coil toward a side of the fixed iron core under the magnetization of the fixed iron core by the power supply to the exciting coil. The node contact breaker means comes into contact (interferes) with the node member at a preset position to make the node member disconnected, which causes the fixed iron core to be demagnetized. The node member being disconnected, the movable iron core temporarily moves toward the fixed iron core under spring force of the diaphragm. When the movable iron core reaches a suction position that defines a maximum amplitude at the fixed iron core side, then the movable iron core moves away from the fixed iron core by spring force of the diaphragm. The node member stays disconnected by the node contact breaker until the movable iron core reaches a position to contact with the node member again. The movable iron core breaks a contact with the node member and makes the node member connected when the movable iron core moves away from the fixed iron core and arrives at a position to come into contact with the node member. Accordingly, the fixed iron core is magnetized by the node member, though the movable iron core temporarily moves away from the fixed iron core under spring force of the diaphragm. When the movable iron core arrives at a spaced position that define a maximum amplitude that is a farthest from the fixed iron core side, the movable iron core moves under suction (performs a suction movement) toward the fixed iron core in proximity by spring force of the diaphragm. The node member stays contacts by the node contact breaker means until the movable iron core reaches a position to contact with the node member again. This sort of conventional electric horn generates a warning sound when the movable iron core is axially displaced with a predetermined amplitude by repetition of the above described movements.

In particular, the movable iron core is configured to be axially displaced with the predetermined amplitude because opposing end surfaces of the fixed and movable iron cores in the axial direction are disposed to face the wire-wound portion of the coil bobbin of the exciting coil.

An example of the above-described electric horn is shown in Japanese Published Unexamined Patent Application No. JP-A-2001-287588.

SUMMARY OF THE INVENTION

The invention relates to an electric horn with an exciting coil that is excited through the electrical conduction, and a magnetic flux density is generated by the excitation of the exciting coil. The magnetic flux density is dispersed to be lowered according to a distance from the wire-wound portion of the coil bobbin and constant in the tubular bore of the coil bobbin, that is, the wire-wound portion.

The end surfaces of the fixed iron core and the movable iron core are located to face each other at the wire-wound portion in the tubular bore of the coil bobbin in the above conventional electric horn. The fixed iron core is magnetized intermittently, and the movable iron core is axially displaced with the predetermined amplitude in the tubular bore of the coil bobbin, that is, an area facing the wire-wound portion. Accordingly, when the fixed iron core is magnetized as the movable iron core is suctioned, the fixed iron core generates larger suction force (magnetic force) based on a constant magnetic flux density and efficiently suctions the movable iron core. However, when the movable iron core is displaced away from the fixed iron core, magnetic force that is generated at the fixed iron core prevents the displacement of the movable iron core away from the fixed iron core. The axial displacement of the movable iron core is thus smaller, the amplitude of the movable iron core also is smaller and, therefore, sound pressure (sound volume) of a warning sound cannot be raised. The present invention solves these problems as well as other problems.

The invention relates to an electric horn that has an exciting coil housed in a bottom part of a closed-end tubular casing. The exciting coil is formed by winding a wire around an outer periphery of a tubular part of a coil bobbin. A fixed iron core is fit to be fixed into an inner peripheral side of the tubular part. The fixed iron core is magnetized according to excitation of the exciting coil. A diaphragm is fixed to an open end of the casing. A movable iron core is provided to a shaft center part of the diaphragm so that the movable iron core and the fixed iron core axially face one another. A warning sound is generated by axially displacing the movable iron core with a predetermined amplitude with respect to the fixed iron core that is magnetized under the excitation of the exciting coil associated with the power supply. The movable iron core is set so that an end face thereof in an amplitude range of the movable iron core can cross over a reference position that is set by an end part of a wire-wound portion on an outer periphery of a tubular part of the exciting coil.

An electric horn according to a further embodiment of the invention has an exciting coil housed in a bottom part of a close-end tubular casing. The exciting coil is formed by winding a wire around an outer periphery of a tubular part of a coil bobbin. A fixed iron core is fixed in an inner peripheral side of the tubular part and is magnetized according to excitation of the exciting coil. A diagram is fixed to an open end of the casing. A movable iron core is provided at a shaft center part of the diaphragm so that the movable iron core and the fixed iron core axially face each other. A node member is provided at a power supply circuit of the exciting coil and a node contact breaker is provided at the movable iron core to break a contact of the node member. With this arrangement, the movable iron core moves under suction from a resting position to be closer to the fixed iron core according to a power supply to the exciting coil via the power supply circuit. The node contact breaker of the movable iron core breaks the contact of the node member of the power supply circuit according to the suction movement of the movable iron core. The movable iron core repeats a movement toward a spaced position at a side of the resting position so as to be displaced with a predetermined amplitude between a suction position at a side of the bottom part of the casing and a spaced position at a side of the open end of the casing to generate a warning sound. A reference position is set by an end part of a wire-wound portion on an outer periphery of a tubular part of the exciting coil. An end face of the movable iron core is closer to the casing bottom part than the reference position in the suction position and closer to the casing open end than the reference position in the spaced position.

The end face of the movable iron core relative to the fixed iron core preferably is positioned at the reference position or closer to the casing bottom part than the reference position when the movable iron core is in a resting position where power is not supplied to the exciting coil.

The end face of the movable iron core relative to the fixed iron core side preferably is closer to the casing open end than the reference position when the movable iron core is in the resting position where power is not supplied to the exciting coil. Additionally, the node contact breaker allows the node member of the power supply circuit to be disconnected when the movable iron core moves under suction toward the fixed iron core according to the power supply to the exciting coil so that the end base of the movable iron core reaches the reference position.

The end base of the fixed iron core relative to the movable iron core preferably is closer to the open end of the casing than a center of a length of the tubular part of the coil bobbin in a tube length direction.

The wire that forms the exciting coil preferably has a wire diameter equal to or less than 0.55 mm. The exciting coil preferably has an inductance equal to or less than 0.7 mH. The resistance of the wire preferably is equal to or greater than 0.6Ω.

A space between the end face of the fixed iron core relative to the movable iron core side and the end face of the movable iron core relative to the fixed iron core preferably is set equal to or smaller than 1.2 mm in a resting state of the movable iron core.

A further embodiment of the invention is directed to an electric horn with a casing formed as a closed-end tube that has an opening at one end and a bottom at the opposed end. A coil bobbin is provided with a tubular part and is located on the bottom of the casing. An exciting coil is formed by winding a wire around the tubular part of the coil bobbin. A fixed iron core is located in the tubular part of the coil bobbin and is magnetized by electric current that is supplied to the exciting coil. A lamellar diaphragm is fixed to an open end of the casing. A movable iron core is fixed to a shaft center part of the diaphragm and is opposed to the fixed iron core. A node member is connected to the exciting coil and performs an on/off control of the electric current supplied to the exciting coil. A node contact breaker is provided to the movable iron core and performs an on/off control of the node member. As a result, the movable iron core moves toward the fixed iron core when the fixed iron core is magnetized by a power distribution to the exciting coil and moves away from the fixed iron core when the node contact breaker acts on the node member to disconnect the power distribution to the exciting coil. Accordingly, an end base of the fixed iron core that is opposed to the movable iron core is positioned adjacent to the movable iron core over a center of a length of a tubular part of the coil bobbin in a tube length direction.

A reference position may be set by an end part of a wire wound portion at an outer peripheral side of the tubular part of the exciting coil. The end part of the wire wound portion preferably is adjacent to the movable iron core. An end face of the movable iron core opposed to the fixed iron core preferably is closer to a side of the casing bottom part than the reference position in an suction position where the end face of the movable iron core is closest to the fixed iron core. Additionally, the end face of the movable iron core that is opposed to the fixed iron core preferably is closer to the casing open end than the reference position in a spaced position where the movable iron core is farthest from the fixed iron core.

The end face of the movable iron core that is opposed to the fixed iron core preferably is at the reference position or closer to the casing bottom part than the reference position when power is not supplied to the exciting coil.

According to the invention, the sound pressure can be raised because an amplitude of a movable iron core is set larger.

According to further aspects of the invention, an electric horn can be provided with more preferable responsiveness.

According to still further aspects of the invention, an electric horn can be provided with more preferable durability.

DETAILED DESCRIPTION OF THE PREFERRED EMBODIMENT

A description is given of an embodiment of the present invention with reference to the drawings.

Figure 1:
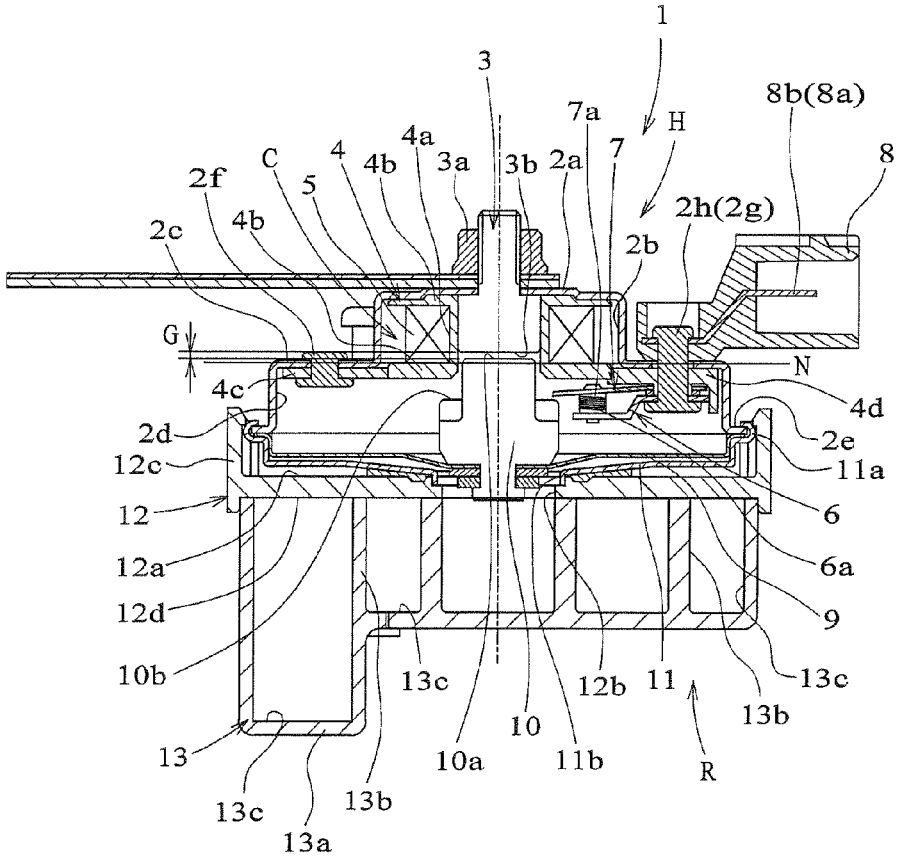
FIG. 1 is a sectional view of an electric horn.

An electric horn 1 includes a vibration generator unit H and a resonator unit R that are integrally fixed in an abutting manner (see FIG. 1). The vibration generator unit H holds a vibration generator. The resonator unit R resonates vibration sound generated by the vibration generator unit H and outputs the resonated vibration sound as a warning sound. The horn 1 of the present embodiment is installed in a vehicle such that the resonator unit R is positioned at a lower part of the horn 1 while the vibration generator unit H is positioned at an upper part of the horn 1.

A casing 2 of the vibration generator unit H is formed to have a closed-end tubular shape with an open low part in FIG. 1. The casing 2 includes a bottom part 2*a*; a small diameter tubular part 2*b* positioned at a side of the bottom part 2*a*; a step part 2*c*; a large diameter tubular part 2*d* formed at an open end side via an opposite side of the step part 2*c* with respect to the small diameter tubular part 2*b* formed to be concentric to the large diameter tubular part 2*d* in an integrated manner; and a flange part 2*e* formed at the open end in an integrated manner so as to spread toward an outer diameter side. A fixed iron core 3 is placed at a shaft center of the small diameter tubular part 2*b* so as to penetrate through the bottom part 2*a*. A fixing nut 3*a* is formed and integrated at a base end of the fixed iron core 3 so as to be supported through the casing 2 and adjustable in an axial direction (upper and lower direction).

A coil bobbin 4 is made of a resin material and includes a tubular part 4*a* that has a tubular bore extending in the upper and lower direction; and flange parts 4*b* that are formed at both tube ends of the tubular part 4*a* so as to extend toward an outer diameter side. An exciting coil C is constructed such that a wire 5 is wound around an outer periphery of the tubular part 4*a*. The coil bobbin 4 is held in the small diameter tubular part 2*b* such that the fixed iron core 3 is inserted in a tube of the tubular part 4*a* while one flange part 4*b* abuts on the casing bottom part 2*a*.

On the flange part 4*b* of the coil bobbin 4 at an open side of the casing 2 are integrally formed a mounting piece part 4*c* and a terminal fixing piece part 4*d* so as to protrude toward an outer diameter side and face each other in a radial direction. The mounting piece part 4*c* is fixed to the casing step part 2*c* of the casing 2 via a pin 2*f*. The terminal fixing piece part 4*d* is fixed to the casing step part 2*c* by first and second pins 2*g*, 2*h* that are made of electrically-conductive members. The second pin 2*h* is provided with a base end part of a fixed plate 6 that has a fixed node 6*a*; and a base end part of a movable plate 7 that has a movable node 7*a*, both of which are made of electrically-conductive plate materials and switches on and off power distribution to the exciting coil C. The fixed plate 6 is electrically connected with the second pin 2*h*. The movable plate 7 is insulated from the second pin 2*h* and electrically connected with an end part of the wire 5. The second pin 2*h* and the end part of the wire 5 are electrically conductive when the fixed node 6*a* and the movable node 7*a* contact with each other. In doing so, an electric current flows to the exciting coil C. The fixed node 6*a* and the movable node 7*a* come into contact with each other in a natural state where no power is supplied.

An outer coupler 8 is connected with an outer power source and houses first and second terminal plates 8*a*, 8*b*. The outer coupler 8 is fixed at an outer face of the casing step part 2*c* by an area of the first and second pins 2*g*, 2*h* that protrude outward (upward) from the casing 2 such that the first and second terminal plates 8*a*, 8*b* and the first and second pins 2*g*, 2*h* are electrically connected with each other. Accordingly, by the fixed node 6*a* and the movable node 7*a*, a contact breakage switching part is formed in a circuit (power source circuit of the exciting coil) that is formed between the exciting coil C and the first and second terminal plates 8*a*, 8*b* for a power supply. The fixed node 6*a* and the movable node 7*a* define node members of the present invention.

A diaphragm 9 with a spring feature includes an outer peripheral edge part that is immovably attached to an open end edge part of the casing 2 in an integrated manner. A movable iron core 10 includes a base end part that is integrally provided at a shaft center part of the diaphragm 9. The movable iron core 10 and the fixed iron core 3 are axially juxtaposed with each other. In a natural state where power is not supplied, a predetermined gap G is formed between an end face 10*a* of the movable iron core 10 in an opposing direction to the fixed iron core 3 and an end face (inner end face, lower end face) 3*b* of the fixed iron core 3 that protrudes inward (downward) from the casing 2. A further description will be later given of a position where the gap G is formed, that is, a positional relationship between the fixed iron core 3 and the movable iron core 10.

When the fixed iron core 3 is magnetized by supplying (distributing) power to excite the exciting coil C, the movable iron core 10 is suctioned from a resting position that is a natural state where power is not supplied toward the fixed iron core 3 based on the spring feature (flexibility) of the diaphragm 9. The movable iron core 10 is then displaced (subject to a suction movement) to a suction position where the end face 10*a* of the movable iron core 10 and the end face 3*b* of the fixed iron core 3 are adjacent to each other. A step part 10*b* is formed at an outer peripheral face of the movable iron core 10 and defines a node contact breaker means of the present invention. When the movable iron core 10 is displaced to a suction position in which its amplitude is maximized at a side of the fixed iron core 3, the step part 10*b* forcibly displaces the movable plate 7 in a direction away from the fixed plate 6 and breaks a contact between the fixed node 6*a* and the movable node 7*a*. Accordingly, the fixed iron core 3 is demagnetized as power distribution to the exciting coil C is disrupted. After the movable iron core 10 reaches the suction position in which its amplitude is maximized at the fixed iron core 3 side, the movable iron core 10 is displaced in a direction away from the fixed iron core 3 under the spring feature of the diaphragm 9. Then, the fixed node 6*a* and the movable node 7*a* come into contact with each other again, and the fixed iron core 3 is excited as power is distributed to the exciting coil C. The movable iron core 10 moves again toward the fixed iron core 3 under the spring feature of the diaphragm 9 when the movable iron core 10 reaches a spaced position in which its amplitude is maximized where the movable iron core 10 is parted furthest from a side of the fixed iron core 3.

By repeating the above movements, the exciting coil C is intermittently excited, the fixed iron core 3 is repeatedly magnetized, and the movable iron core 10 is vibrated together with the diaphragm 9 in an axial direction with a predetermined amplitude W in order to generate a sound. Under a reaction based on the spring feature of the diaphragm 9, the spaced position of the movable iron core 10 lies closer to an open end side of the casing 2 than a position (where the gap G is formed) in the natural state.

A cover member 11 covers an outer part (lower part) of the diaphragm 9 to construct the vibration generator unit H. A caulking piece 11*a* is formed at an outer peripheral edge part of the cover member 11.

The diaphragm 9 and the cover member 11 are fixed at the casing 2 in a sealing manner by making the caulking piece 11*a* face the casing flange part 2*e*, sandwiching an outer peripheral edge part of the diaphragm 9 between the caulking piece 11*a* and the flange part 2*e*, and caulking the caulking piece 11*a* at the flange part 2*e*. A sound output port 11*b* is formed at a shaft center part of the cover member 11, and a base end part of the movable iron core 10 is freely fit in the sound output port 11*b*. A warning sound is generated based on vibration of the diaphragm 9 and discharged (output) outward (downward) from the cover member 11 through the sound output port 11*b*.

A planar base member 12 and a frame member 13 that covers the base member 12 from outside are included in the resonator unit R that is fixed at a lower part of the vibration generator unit H in abutting contact with each other.

The base member 12 includes an upper plate face 12*a*; a sound input port 12*b*; and a tubular outer fitting piece 12*c*. The upper plate face 12*a* is placed to face the cover member 11, the sound input port 12*b* is formed at a central part and the tubular outer fitting piece 12*c* is formed at an outer peripheral part of one side plate face 12*b* to protrude toward the cover member 11. The resonator unit R and the vibration generator unit H are integrated such that a protrusion end part of the outer fitting piece 12*c* is fit with a pressure to caulking parts of the casing 2 and the cover member 11.

The frame member 13 includes a hood piece 13*a* and a spiral partition piece 13*b*. The hood piece 13*a* is disposed to face the other side plate face 12*d* of the base member 12 so as to cover the other side plate face 12*d*. The spiral partition piece 13*b* protrudes toward the base member 12 from an inner face of the hood piece 13*a*. The frame member 13 further includes a spiral sound path 13*c*. The outer peripheral edge part of the hood piece 13*a* and a protrusion end edge part of the partition piece 13*b* are fixed in a sealing and abutting manner to the other side plate face 12*d* of the base member 12 so as to achieve an integration with the base member 12. The spiral sound path 13*c* is formed between the base member 12 and the frame member 13 and communicatively connected outside from the sound input port 12*c*. Accordingly, a warning sound is generated based on vibration generator unit H, guided to the sound path 13*c* through the sound output port 11*b* and the sound input port 12*b* and discharged outside.

Figure 2:
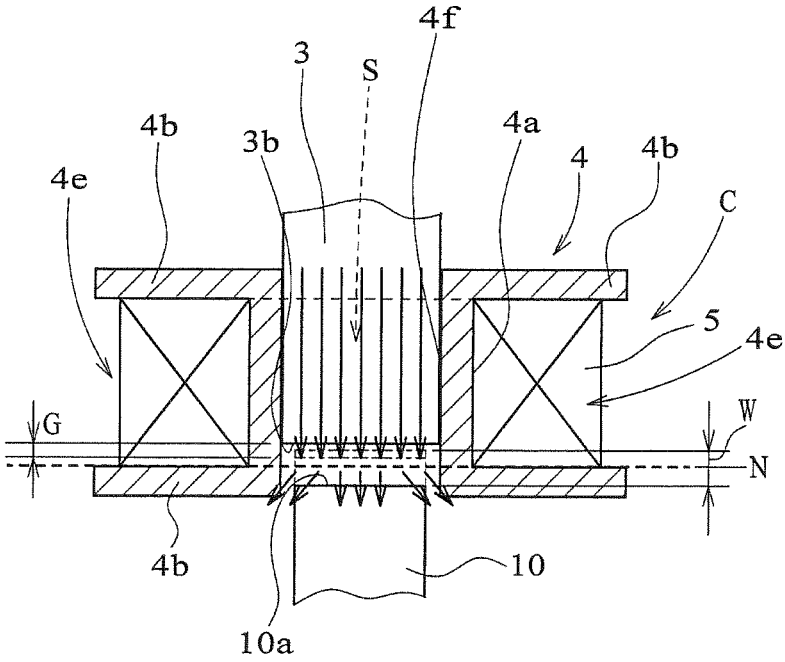
FIG. 2 is a sectional view of a main part of the electric horn.
Figure 3:
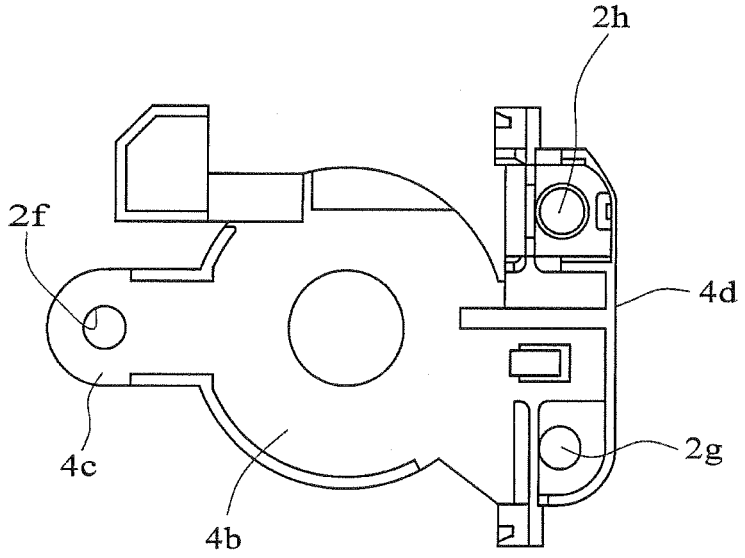
FIG. 3 is a bottom view for illustrating details of a coil bobbin.

The electric horn 1 of the present embodiment can maintain an increased sound pressure (sound volume) of a warning sound by disposing the fixed iron core 3 and the movable iron core 10 as illustrated in FIG. 2.

The exciting coil C is formed by winding the wire 5 around the outer periphery of the tubular part 4*a* of the coil bobbin 4 as described above. The wire-wound portion 4*e* of the present invention is defined by the parts between the opposing flange parts 4*b* that are formed at the tubular part 4 tube ends. When the exciting coil C is excited by power distribution thereto, magnetic force with a preset constant magnetic flux density is generated at a wire-wound-portion-facing-range S that faces the wire-wound portion 4*e* at a tubular bore 4*f* inside the tubular part 4*a*. The magnetic flux is dispersed from the tubular bore 4*f* toward an outer diameter side in an end part area of the tubular bore 4*f*, which defines an area that is placed out of the wire-wound portion 4*e*. Accordingly, the density of the magnetic flux is reduced.

In the present embodiment, a reference position N is positioned at a place where magnetic flux density changes, the place defining an end part position at an open end side of the casing 2 of the wire-wound portion 4*e* of the exciting coil C (position illustrated by a dotted line in FIG. 2). That is, the sound pressure is ensured by disposing the fixed iron core 3 and the movable iron core 10 based on the reference position N in the present embodiment.

In the resting state of the horn 1 in which no warning sound is output as no power is supplied to the first and second terminal plates 8*a*, 8*b*, the end face 10*a* of the movable iron core 10 is positioned at the reference position N or a resting position that is slightly deviated from the reference position N toward a side of the bottom part 2*a* of the casing 2 (toward a side of the wire-wound portion 4*e*, or in a direction closer to the fixed iron core 3 as illustrated by a long dashed double-short dashed line in FIG. 2). The fixed iron core 3 is disposed such that the end face 3*b* at a side of the movable iron core 10 is positioned closer to a side of the bottom part 2*a* of the casing 2 (upward in FIG. 2) than the movable iron core end face 10*a*, and the predetermined gap G exists between the end face 3*b* and the movable iron core end face 10*a*. When power is supplied to the exciting coil C via the first terminal plate 8*c* and the second terminal plate 8*b*, because the movable iron core 10 is at the reference position N or adjacent to the reference position N, the movable iron core 10 is capable of being quickly displaced to the suction position at a side of the fixed iron core 3 by receiving a higher magnetic flux density under the excitation of the exciting coil C. The fixed iron core 3 is disposed such that the end face 3*b* that is opposed to the movable iron core 10 is placed to be adjacent to the movable iron core 10 over a center of the tubular part 4*a* of the coil bobbin 4 in its tube length direction. By this configuration, the heat that is generated at the exciting coil C under the power distribution of the exciting coil C can be released to the casing 2 via the fixed iron core 3 and the tubular part 4*a* of the coil bobbin 4. The horn 1 can thus be provided with improved heat resistance and durability.

The movable iron core 10 is positioned at either the suction position or the spaced position when a warning sound is generated as the exciting coil C is repeatedly excited under continued power supply to the exciting coil C. In the suction position (as illustrated by an alternate long and short dashed line in FIG. 2), the end face 10*a* crosses over the reference position N to be positioned at a side of the wire-wound portion 4*e*. In the spaced position (as illustrated by a continuous line in FIG. 2), the end face 10*a* crosses over the reference position N by reaction under the spring feature of the diaphragm 9 to be positioned at an open end side of the casing 2 where the magnetic flux is dispersed and its density is decreased. A range of movement of the movable iron core end face 10*a* crosses over the reference position N in an amplitude W of the movable iron core 10. In displacement of the movable iron core 10 toward the spaced position, an effect of the suction force (magnetic force) to the movable iron core 10 toward the casing bottom part 2*a* is further decreased because the end face 10*a* is displaced toward the bottom part 2*a* of the casing 2 relative to the reference position N and a remaining magnetic force in the exciting coil C is dispersed so as to reduce its magnetic flux density at a corresponding area. Accordingly, the movable iron core 10 can be largely displaced toward the casing bottom part 2*a*, and, therefore, the larger amplitude W of the movable iron core 10 is achieved.

The electric horn 1 outputs a warning sound with the vibration sound of the diaphragm 9 because the intermittent excitation of the exciting coil C magnetizes the fixed iron core 3 repeatedly, the fixed iron core 3 displaces the movable iron core 10, which is coupled with the diaphragm 9, between the suction position and the spaced position, and the movable iron core 10 vibrates with the predetermined amplitude W in the above-configured present embodiment. The amplitude W of the movable iron core 10 is configured such that the movable iron core 10 vibrates in a range including the reference position N that defines the end part position at the casing bottom part 2*a* of the wire-wound portion 4*e* of the coil bobbin 4. Accordingly, the effect of the magnetic force, which remains in the exciting coil C during the displacement to the spaced position, is decreased while the amplitude W is larger. The sound pressure of the electric horn 1 is thus raised.

The end face of the movable iron core 10 is positioned at the reference position N or at a side of an area that is opposed to the wire-wound portion 4*e* at the casing bottom part 2*a* side relative to the reference position N in the resting state of the electric horn 1. Accordingly, the electric horn 1 can be highly-responsive in quickly displacing the movable iron core 10 to the suction position at the fixed iron core 3 side by receiving higher magnetic flux density associated with the excitation of the exciting coil C when power is supplied to the electric horn 1.

Table 1 below shows test results of characteristics of electric horns A to C. The horns A to C were provided with all of the above structural features of the electric horn 1. A coil wire diameter of the horns A to C was set to be 0.47 mm. Measurements were made by changing a coil turn that defines a number of coil wound around an exciting coil, a magnetic gap that defines a space between a movable iron core and a fixed iron core in a resting state, etc.

TABLE 1

| dItems | Horn A | Horn B | Horn C |
|---|---|---|---|
| Coil Wire Diameter (mm) | 0.47 | 0.47 | 0.47 |
| Magnetic Gap (mm) | 1.10 | 1.10 | 1.20 |
| Coil Turn (T) | 125 | 135 | 105 |
| Applied Voltage (V) | 13 | 13 | 13 |
| Inductance (mH) | 0.61 | 0.71 | 0.43 |
| Wire Resistance (Ω) at 20° C. | 0.69 | 0.76 | 0.56 |
| Spark (Irms · T) | 442 | 423 | 486 |
| Suction Force (Ipk · T/gap^2) | 365 | 349 | 338 |

The horns A and B were given a magnetic gap of 1.10 mm and respectively a coil turn of 125 times and 135 times. It is evident from the above Table 1 that an inductance of a coil and a wire resistance increase in proportion to a coil turn. When a wire resistance and an inductance increase, a calorific value by current being distributed to an exciting coil decreases, and a calorific value by a spark being generated in switching on and off of a node member also decreases. Because magnetomotive force of a coil decreases, suction force in itself for suctioning the movable iron core also decreases.

The horns A and C were respectively given a magnetic gap of 1.10 mm and 1.20 mm and a coil turn of 125 times and 105 times. It is evident from the above Table 1 that suction force decreases in inverse proportion to a distance of a magnetic gap. Because an inductance of a coil and a wire resistance increase in proportion to a coil turn, a calorific value by current being distributed to an exciting coil decreases, and a calorific value by a spark being generated in switching on and off of a node member also decreases. Because magnetomotive force of a coil decreases, suction force in itself for suctioning the movable iron core also decreases.

According to the measurement results on the horns A, B and C, by setting the magnetic gap to be 1.2 mm or less, the inductance to be 0.7 mH or less, and the wire resistance to be 0.6Ω or more, then the magnetomotive force that is generated by the coil, that is, the suction force (sound pressure of a horn) for suctioning the movable iron core is larger, the calorific value by a spark that is generated in switching on and off of the node member decreases, and a horn is provided with satisfactory suction force and excellent durability. More preferably, the magnetic gap may be set to be 1.15 mm or less, the inductance to be 0.65 mH or less, and the wire resistance to be 0.65Ω or more.

The present invention is not limited to the above embodiment. The position of the end face of the movable iron core at the movable iron core side at the resting position can be set to be much closer to the casing open side than the reference position that defines the end part of the casing open end side (movable iron core side) of the wire-wound portion of the exciting coil. In this case, the movable iron core can be displaced to cause the node member disconnected while receiving higher magnetic flux density associated with excitation of the exciting coil by setting the end face position of the movable iron core at the reference position in a state the node member of the power supply circuit is caused to be disconnected by the node contact breaker means of the movable iron core. Accordingly, an electric can be realized with a higher sound pressure.

The present disclosure relates to an electric horn to be installed in a vehicle, such as a passenger car, and enables an exciting coil to generate an enlarged magnetomotive force. That is, an enlarged suction force is available for suctioning a movable iron core. Further, a large amplitude of a movable iron core is to be switched on/off by a node member so as to raise a sound pressure. Further, a calorific value caused by a spark generated in switching on and off of the node member can be decreased, and a horn can be provided with satisfactory suction force and excellent durability.

What is claimed is:

1. An electric horn, comprising:

an exciting coil that is housed in a bottom part of a closed-end tubular casing, the exciting coil having a wire-wound portion formed by winding a wire around an outer peripheral side of a tubular part of a coil bobbin;

a fixed iron core that is fit to be fixed into an inner peripheral side of the tubular part, the fixed iron core being magnetized according to excitation of the exciting coil;

a diaphragm that is fixed to an open end of the casing; and a movable iron core that is provided to a shaft center part of the diaphragm, the movable iron core and the fixed iron core being placed to axially face each other, wherein:

a suction position that is set as the position where the movable iron core is the closest to the end face of the fixed iron core, a spaced position that is set as the position where the movable iron core is farthest to the end face of the fixed iron core, a reference position that is set by an end part, relative to a side of the movable iron core, of the wire-wound portion of the exciting coil, wherein the suction position is closer to the end of the fixed iron core than the reference position, the spaced position is farther from the end of the fixed iron core than the reference position, the movable iron core moves toward the suction position as the fixed iron core being magnetized by excitation of the exciting coil with connecting a power supply, the movable iron core moves away from the fixed iron core toward the spaced position as the fixed iron core being demagnetized by disruption of the exciting coil with disconnecting the power supply, and a warning sound is generated by the movable iron core moving repeatedly between the suction position and the spaced position over the reference position with a predetermined amplitude range.

2. An electric horn, comprising:

an exciting coil that is housed in a bottom part of a closed-end tubular casing, the exciting coil having a wire-wound portion formed by winding a wire around an outer peripheral side of a tubular part of a coil bobbin;

a fixed iron core that is fit to be fixed into an inner peripheral side of the tubular part, the fixed iron core being magnetized according to excitation of the exciting coil;

a diaphragm that is fixed to an open end of the casing;

a movable iron core that is provided to a shaft center part of the diaphragm, the movable iron core and the fixed iron core being placed to axially face each other; and a node member that is provided to a power supply circuit of the exciting coil; and a node contact breaker that is provided to the movable iron core so as to break a contact of the node member, wherein:

a suction position that is set as the position where the movable iron core is the closest to the end face of the fixed iron core, a spaced position that is set as the position where the movable iron core is farthest to the end face of the fixed iron core, a resting position that is set as the position where the movable iron core is rested when a power is not supplied to the exciting coil, a reference position that is set at an end part, relative to a side of the movable iron core, of a wire-wound portion of the exciting coil, the suction position is closer to the end of the fixed iron core than the reference position, the spaced position is farther from the end of the fixed iron core than the reference position, wherein:

the movable iron core moves under suction to the suction position from a resting position to be closer to the fixed iron core according to a power supply to the exciting coil via the power supply circuit, the node contact breaker of the movable iron core breaks the contact of the node member of the power supply circuit according to the movement of the movable iron core to the suction position, and the movable iron core moves from the suction position toward a spaced position by breaking the contact of the node member and repeats a movement with a predetermined amplitude between the suction position at a side of the bottom part of the casing and the spaced position at a side of the open end of the casing in order to generate a warning sound, wherein:

an end face, relative to a side of the fixed iron core, of the movable iron core moves closer to the casing bottom part side than the reference position in the suction position and moves closer to the casing open end side than the reference position in the spaced position.

3. The electric horn according to claim 2, wherein, in the resting position where power is not supplied to the exciting coil, the end face of the movable iron core relative to the fixed iron core side is positioned at the reference position or closer to the casing bottom part side than the reference position.

4. The electric horn according to claim 2, wherein:

the end face of the movable iron core relative to the fixed iron core side is positioned closer to the casing open end side than the reference position in the resting position where power is not supplied to the exciting coil, and the node contact breaker allows the node member of the power supply circuit to be disconnected when the movable iron core moves under suction toward the fixed iron core according to the power supply to the exciting coil such that the end face of the movable iron core reaches the reference position.

5. The electric horn according to claim 4, wherein an end face of the fixed iron core relative to the movable iron core side is positioned closer to the open end side of the casing than a center of a length of the tubular part of the coil bobbin in a tube length direction.

6. The electric horn according to claim 5, wherein the wire that forms the exciting coil has a wire diameter equal to or smaller than 0.55 mm, the exciting coil has an inductance equal to or smaller than 0.7 mH, and a resistance of the wire is equal to or larger than 0.6Ω.

7. The electric horn according to claim 6, wherein a space between the end face of the fixed iron core relative to the movable iron core side and the end face of the movable iron core relative to the fixed iron core side is set to be equal to or smaller than 1.2 mm in a resting state of the movable iron core.

8. An electric horn, comprising:

a casing that is formed to be a closed-end tubular and has an opening part at one end and a bottom part at another end;

a coil bobbin that has a tubular part and is located on the bottom part of the casing;

an exciting coil having a wire-wound portion that is formed by winding a wire around the tubular part of the coil bobbin;

a fixed iron core that is located in the tubular part of the coil bobbin and magnetized by electric current that is supplied to the exciting coil;

a lamellar diaphragm that is fixed to an open end of the casing;

a movable iron core that is fixed to a shaft center part of the diaphragm and placed to be opposed to the fixed iron core;

a node member that is connected to the exciting coil so as to perform an on-off control of the electric current that is supplied to the exciting coil; and a node contact breaker that is provided to the movable iron core so as to perform an on-off control of the node member, wherein:

the following movements are repeated that:

the movable iron core moves toward the fixed iron core when the fixed iron core is magnetized under a power distribution to the exciting coil, and the movable iron core moves away from the fixed iron core when the node contact breaker acts on the node member to disconnect the power distribution to the exciting coil, wherein:

an end face of the fixed iron core that is opposed to the movable iron core is positioned to be adjacent to the movable iron core over a center of a length of a tubular part of the coil bobbin in a tube length direction, a reference position is set at an end part of the wire-wound portion at an outer peripheral side of a tubular part of the exciting coil, the end part being adjacent to the movable iron core, an end face of the movable iron core that is opposed to the fixed iron core moves closer to a side of the casing bottom part than the reference position in a suction position where the end face of the movable iron core moves at a closest point to the fixed iron core, and the end face of the movable iron core that is opposed to the fixed iron core moves closer to a side of the casing open end than the reference position in a spaced position where the end face of the movable iron core moves at a farthest point from the fixed iron core.

9. The electric horn according to claim 8, wherein, in a resting position where power is not supplied to the exciting coil, the end face of the movable iron core that is opposed to the fixed iron core is positioned at the reference position or closer to the casing bottom part side than the reference position.

10. The electric horn according to claim 8, wherein:

the end face of the movable iron core that is opposed to the fixed iron core is positioned closer to the side of the casing open end than the reference position in a resting state where power is not supplied to the exciting coil, and the node contact breaker allows the node member to be disconnected in a synchronized manner when the end face of the movable iron core that is opposed to the fixed iron core reaches the reference position while the movable iron core moves under suction toward the fixed iron core under a power supply to the exciting coil.

11. The electric horn according to claim 10, wherein the wire that forms the exciting coil has a wire diameter equal to or smaller than 0.55 mm, the exciting coil has an inductance equal to or smaller than 0.7 mH, and a resistance of the wire is equal to or larger than 0.6Ω.

12. The electric horn according to claim 11, wherein a space between the end face of the fixed iron core that is opposed to the movable iron core and the end face of the movable iron core that is opposed to the fixed iron core is set to be equal to or smaller than 1.2 mm in a resting state of the movable iron core.

* * * * *